United States Patent [19]

Shaw

[11] 4,240,267

[45] Dec. 23, 1980

[54] SYSTEM FOR VAPORIZING CARBON DIOXIDE UTILIZING THE HEAT BY-PRODUCT OF THE REFRIGERATION SYSTEM AS A HEAT SOURCE

[75] Inventor: Harold L. Shaw, Marietta, Ga.

[73] Assignee: The Coca-Cola Company, Atlanta, Ga.

[21] Appl. No.: 966,273

[22] Filed: Dec. 4, 1978

[51] Int. Cl.[3] ..... F25B 27/02; F25B 13/00

[52] U.S. Cl. ..... 62/238 E; 62/324 D

[58] Field of Search ..... 62/52, 238 E, 324 D

[56] References Cited

U.S. PATENT DOCUMENTS

| | | | |
|---|---|---|---|
| 1,874,803 | 8/1932 | Reed | 62/238 E |
| 2,003,310 | 6/1935 | Rexwinkle | 62/238 |
| 2,021,073 | 11/1935 | Maiuri | 62/238 |
| 2,418,446 | 4/1947 | Anderson | 62/238 E |
| 3,055,187 | 9/1962 | Rogers | 62/238 |
| 3,366,166 | 1/1968 | Gerteis | 62/324 D |
| 3,916,638 | 11/1975 | Schmidt | 62/238 E |
| 3,926,008 | 12/1975 | Webber | 62/238 E |
| 4,019,338 | 4/1977 | Poteet | 62/238 E |
| 4,098,092 | 7/1978 | Singh | 62/238 E |
| 4,142,379 | 3/1979 | Kuklinski | 62/238 E |

*Primary Examiner*—Lloyd L. King

*Attorney, Agent, or Firm*—Birch, Stewart, Kolasch & Birch

[57] ABSTRACT

The present invention is directed to a carbonation and refrigeration system wherein the heat of the refrigerant output side of the refrigeration compressor is utilized to vaporize liquid carbon dioxide into $CO_2$ gas which is introduced into a liquid product. The carbonation and refrigeration system successfully utilizes the heat of the refrigerant to vaporize the $CO_2$ liquid regardless of the cooling demand of the system caused by seasonal temperature variations. For example during the winter months when the cooling demand is as low as 10% of the cooling demand in the summer, the carbonation and refrigeration system operates effectively to vaporize the $CO_2$ liquid by means of a heat exchanger and a desuperheater which are connected in communication with the superheated vapor emerging from the output side of a refrigeration compressor. In addition, the carbonation and refrigeration system of the present invention cools more efficiently by extracting some of the heat from the condensed refrigerant entering the receiver of the refrigeration system. In this manner, the refrigeration compressor can operate more efficiently.

15 Claims, 2 Drawing Figures

SYSTEM FOR VAPORIZING CARBON DIOXIDE UTILIZING THE HEAT BY-PRODUCT OF THE REFRIGERATION SYSTEM AS A HEAT SOURCE

BACKGROUND OF THE INVENTION

1. Field of the Invention

The present invention is directed to a carbonation and refrigeration system wherein the heat of the refrigerant at the output side of the refrigeration compressor is utilized to vaporize liquid carbon dioxide into $CO_2$ gas which is introduced into a liquid product, such as water, syrup, or a mixture thereof for making a carbonated soft drink.

2. Description of the Prior Art

Many exemplary refrigeration systems are disclosed in the prior art which utilize heat by-products from the refrigeration systems to perform ancillary functions. For example, U.S. Pat. No. 2,000,310, to Rexwinkle discloses a refrigeration system wherein the heat by-product from the refrigeration is utilized to produce steam to perform useful work. The refrigeration system disclosed in the Rexwinkle patent employs exchangers operated at sufficiently high temperatures to generate steam from the cooling water. Ordinarily the cooling water is at a low heat level and the heat absorbed thereby is wasted. The refrigeration system disclosed in the Rexwinkle patent operates at a higher heat level so that the cooling water is converted into steam.

U.S. Pat. No. 2,021,073 to Maiuri discloses a method of producing solid carbon dioxide without the use of expensive compressors. In addition, the heat required for operating the absorption refrigerating machines and for driving the carbon dioxide gas out of the sodium solution can be obtained from the combustion of coke to produce the carbon dioxide gas. The Maiuri patent discloses that heat can be used to generate steam for a steam engine driving the single stage compressor j.

U.S. Pat. No. 3,055,187 to Rogers discloses that heat from an automobile exhaust may be utilized to vaporize the freon used in the refrigeration system.

Although the patents mentioned above disclose the general concept of utilizing a heat by-product from one process to perform useful work in another process they do not disclose a combined refrigeration and carbonation system wherein the heat generated by the refrigeration system is utilized to vaporize carbon dioxide liquid into $CO_2$ gas to assist in the carbonation process.

SUMMARY OF THE INVENTION

It is an object of the present invention to provide a carbonation and refrigeration system wherein the heat of the refrigerant at the output side of the refrigeration compressor is utilized to vaporize liquid carbon dioxide $CO_2$ gas which is introduced into the liquid product.

A further object of the present invention is to provide a carbonation and refrigeration system wherein the heat from the refrigerant may be successfully utilized to vaporize the carbon dioxide liquid regardless of the cooling demand of the system caused by seasonal temperature variations.

A still further object of the present invention is to provide a carbonation and refrigeration system which includes a heat exchanger and a desuperheater which are connected in communication with the superheated vapor emerging from the output side of a refrigeration compressor.

Another object of the present invention is to provide a carbonation and refrigeration system which extracts some of the heat from the condensed refrigerant entering the receiver of the refrigeration system so that the refrigeration compressor operates more efficiently.

These and other objects of the present invention are accomplished by providing a carbonation and refrigeration system wherein the heat of the refrigerant at the output side of the refrigeration compressor is utilized to vaporize liquid carbon dioxide into $CO_2$ gas which is introduced into the liquid product. The carbonation and refrigeration system successfully utilizes the heat from the refrigerant to vaporize the carbon dioxide liquid regardless of the cooling demand of the system caused by seasonal temperature variations. In addition, the carbonation and refrigeration system of the present invention includes a heat exchanger and a desuperheater which are connected in communication with the superheated vapor emerging from the output side of a refrigeration compressor. By extracting some of the heat from the condensed liquid entering the receiver of the refrigeration system, the refrigeration compressor can operate more efficiently.

Further scope of applicability of the present invention will become apparent from the detailed description given hereinafter. However, it should be understood, that the detailed description and the specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are are not limitative of the present invention, and wherein.

DETAILED DESCRIPTION OF THE INVENTION

The present invention is directed to a carbonation and refrigeration system wherein the heat of the refrigerant at the output side of the refrigeration compressor is utilized to vaporize liquid carbon dioxide into $CO_2$ gas which is introduced into a liquid product.

Figure 1:
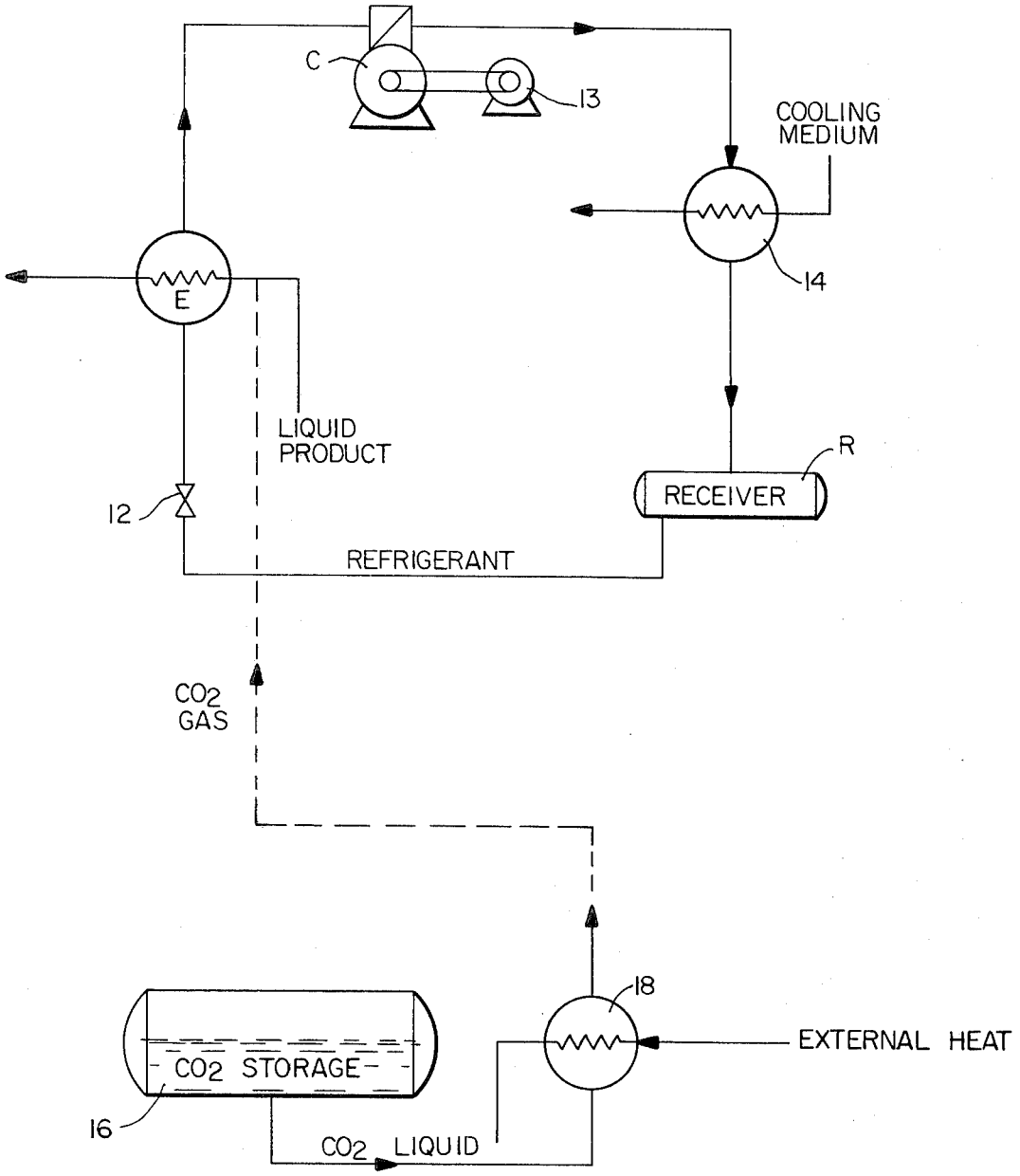
PRIOR ART FIG. 1
FIG. 1 illustrates a schematic view of a conventional, prior art refrigeration system including a separate carbon dioxide supply system.

According to the conventional, prior art system of refrigeration in combination with a source of carbon dioxide as illustrated in FIG. 1, a certain amount of energy is expended to refrigerate a product and an additional amount of energy is expended to vaporize carbon dioxide liquid into $CO_2$ gas which is subsequently introduced into the liquid product. As illustrated in FIG. 1, the refrigerant is drawn from a receiver R at approximately 95° F. The liquid refrigerant is admitted through a valve 12 to the evaporator E. As the liquid refrigerant passes through the valve 12 a portion of the refrigerant flashes to a temperature of approximately 30° F. and as a result the temperature of the remaining liquid refrigerant is reduced to about 30° F. also as it passes through the valve 12.

The liquid refrigerant now at a temperature of approximately 30° F. is introduced into the evaporator or heat exchanger E together with the liquid product to be refrigerated. Heat flows through the retaining walls of the evaporator or heat exchanger E causing the liquid refrigerant to evaporate. This evaporation of the liquid refrigerant causes a reduction in the temperature of the liquid product from approximately 75° F. to 40° F. As is conventional gaseous $CO_2$ is also introduced into the liquid product either before, during or after the cooling of the product. It is necessary to cool the product in order to increase the solubility of the $CO_2$ gas so that the desired amount of the $CO_2$ gas can be disolved into the liquid product.

As illustrated in FIG. 1, the refrigerant is directed from the evaporator or heat exchanger E to the compressor C where the pressure of the refrigerant is elevated to a value such that the refrigerant may be condensed to a liquid at a temperature above that of the available cooling or condensing medium.

The cooling or condensing medium is usually a natural source such as surface water, tap water or ambient air. Most large-scale installations employ evaporative cooling of water into ambient air as the source of supplying a condensing or cooling medium. Therefore, the wet-bulb temperature of the ambient air dictates the refrigerant condensing temperature.

As is conventional, the compressor C is driven by a motor 13. The refrigerant which is introduced into the compressor C is increased in pressure and the actual temperature of the refrigerant gas is elevated to a much higher temperature than the temperature at which it will condense. This elevation in temperature is the result of superheating which occurs when the refrigerant is compressed by the compressor.

The refrigerant and a cooling medium are introduced into a condensor 14 where the superheat and the latent heat of the refrigerant are transferred to the cooling medium. This results in the condensing of the gaseous refrigerant into a liquid. The resultant liquid is drained or pumped to a receiver vessel R where it is again available to be introduced into the evaporator E.

As illustrated in FIG. 1, liquid carbon dioxide is contained within a storage vessel 16 at a temperature of approximately 0° F. and at a pressure of approximately 300 psig. The liquid carbon dioxide must be converted into $CO_2$ gas by supplying the latent heat of vaporization to the liquid. As is conventional, the liquid carbon dioxide and a supply of heat are introduced into a heat exchanger 18. The supply of heat may be in the form of steam or electric resistance heaters. By supplying an external source of heat to the heat exchanger 18 the liquid carbon dioxide is converted into $CO_2$ gas at approximately 0° to 50° F. and at a pressure of approximately 300 psig. This $CO_2$ gas is introduced into the liquid product as discussed hereinabove.

The conventional, prior art, refrigeration and carbonation system illustrated in FIG. 1 suffers from the disadvantage that an external source of energy must be supplied to the heat exchanger 18 to convert the liquid carbon dioxide into $CO_2$ gas. This external source of energy is usually in the form of electric energy or fossil fuel energy. Because the conventional prior art refrigeration and carbonation system is tied to an external source of energy, as the cost of the external source of energy increases the cost of refrigerating and carbonating a liquid product also increases.

Figure 2:
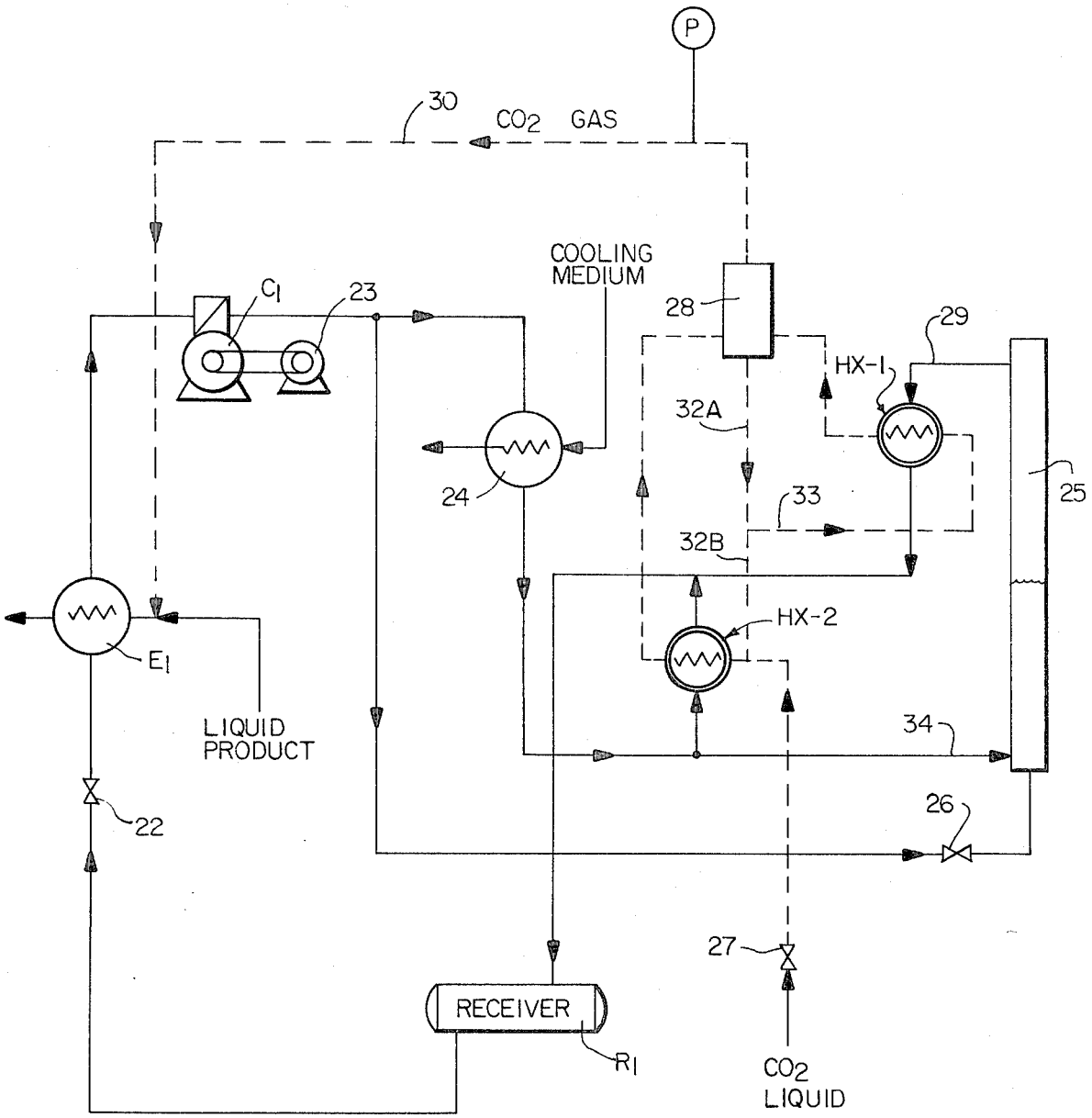
FIG. 2 illustrates a schematic view of a combined carbonation and refrigeration system according to the present invention.

The carbonation and refrigeration system of the present invention overcomes the disadvantages of the conventional, prior art refrigeration and carbonation system as discussed hereinabove. As illustrated in FIG. 2, the present invention utilizes the heat of the refrigerant at the output side of the refrigeration compressor to vaporize liquid carbon dioxide into $CO_2$ gas which is subsequently introduced into the liquid product.

The carbonation and refrigeration system illustrated in FIG. 2 includes a receiver $R_1$ which contains a supply of liquid refrigerant. The liquid refrigerant is admitted through a valve 22 to the evaporator $E_1$. As the liquid refrigerant passes through the valve 22 a portion of the refrigerant flashes to vapor thus reducing the remaining liquid refrigerant to a temperature of approximately 30° F.

The liquid refrigerant now at a temperature of approximately 30° F. is introduced into the evaporator or heat exchanger $E_1$ together with the liquid product to be refrigerated. Heat flows through the retaining walls of the evaporator or heat exchanger $E_1$ causing the liquid refrigerant to evaporate. This evaporation of the liquid refrigerant causes a reduction in the temperature of the product from approximately 75° F. to 40° F. The cooling of the liquid product is essentially the same as described hereinabove with reference to FIG. 1. However, the gaseous $CO_2$ which is introduced into the liquid product either before, during or after the cooling of the product is converted from liquid carbon dioxide to $CO_2$ gas by utilizing the heat of the refrigerant.

As illustrated in FIG. 2, the refrigerant is directed from the evaporator or heat exchanger $E_1$ to the compressor $C_1$ where the pressure of the refrigerant is elevated to a value such that the refrigerant may be condensed to a liquid at a temperature above that of the available cooling or condensing medium. As is conventional, the compressor $C_1$ is driven by a motor 23. The refrigerant which is introduced into the compressor $C_1$ is increased in pressure and the actual temperature of the refrigerant is elevated to a much higher temperature than the temperature at which it will condense. The hot refrigerant gas, at this elevated temperature, is divided so that a portion thereof is directed to the condenser 24. The remaining portion of the hot refrigerant gas is connected to a desuperheater 25. A valve 26 regulates the second portion of the hot refrigerant gas which is introduced into the desuperheater 25.

The first portion of the hot refrigerant gas and a cooling medium are introduced into a condensor 24 where the superheat and the latent heat of the refrigerant are transferred to the cooling medium. This results in the condensing of the gaseous refrigerant into a liquid. The resultant liquid is supplied to a heat exchanger HX-2 and to a lower portion of the desuperheater 25.

The heat exchanger HX-2 is positioned below the outlet of the condensor 24. Liquid refrigerant flows into the bottom portion of the heat exchanger HX-2 and overflows at the top outlet thereof. The liquid refrigerant directed from the top outlet of the heat exchanger HX-2 is supplied to the receiver $R_1$ where it is again available to be introduced into the evaporator $E_1$. By positioning the heat exchanger HX-2 below the outlet of the condensor 24 the liquid refrigerant may be supplied to the heat exchanger HX-2 and to the receiver $R_1$ by means of gravity.

Liquid refrigerant at approximately 95° F. together with liquid carbon dioxide at approximately 0° F. are supplied to the heat exchanger HX-2. The supply of liquid carbon dioxide is regulated by means of the valve 27. The heat of the liquid refrigerant is transmitted to the liquid carbon dioxide resulting in a vaporization of all (or a portion of) the liquid carbon dioxide. The vaporized $CO_2$ gas together with any carbon dioxide liquid is supplied from the heat exchanger HX-2 to a vapor-liquid separator 28.

The refrigerant desuperheater 25 is positioned in such a manner so as to receive liquid refrigerant from the condensor 24 preferably by means of gravity. The height of the liquid refrigerant in the desuperheater 25 is controlled by the height of the liquid refrigerant in the drain line from the condensor 24 and the top outlet overflow of the heat exchanger HX-2. As illustrated in FIG. 2, the bottom portion of the desuperheater 25 is connected to a hot refrigerant gas line which is directly connected to the discharge side of the compressor $C_1$.

The outlet line 29 of the desuperheater 25 is connected to a second heat exchanger HX-1. The second heat exchanger HX-1 is positioned slightly above the condensor 24. Desuperheated refrigerant gas from the desuperheater 25 together with liquid carbon dioxide from the vapor liquid separator 28 through line 32A (or alternatley through line 32B) are supplied to the second heat exchanger HX-1. The heat of the refrigerant gas is transferred to vaporize the liquid carbon dioxide into $CO_2$ gas. The resulting $CO_2$ gas is supplied to the vapor-liquid separator 28.

The refrigerant supplied to the heat exchanger HX-1 is condensed into a liquid refrigerant which is supplied to the receiver $R_1$ where it is again available to be introduced into the evaporator $E_1$.

The vapor-liquid separator 28 for the carbon dioxide is positioned above the carbon dioxide outlet of both the heat exchanger HX-2 and the second heat exchanger HX-1. The gaseous $CO_2$ positioned in the uppermost portion of the vapor liquid separator 28 is supplied to the liquid product, either before, during or after the cooling of the product by the evaporator or heat exchanger $E_1$. A pressure gauge P is connected to the supply line 30 which directs $CO_2$ gas from the separator 28 to the conduit in which the liquid product is supplied. The pressure of the $CO_2$ gas in the supply line 30 may be regulated by the adjustment valve 27 which regulates the quantity of liquid carbon dioxide which enters the system. If desired pressure gauge P may be connected to valve 27 in a servo control loop to automatically adjust valve 27 to maintain the pressure in line 30 at a predetermined level.

The desuperheater 25 is connected at the lowermost portion thereof to a hot refrigerant gas line. The supply of hot refrigerant gas admitted to the desuperheater 25 is regulated by means of the valve 26. In addition, liquid refrigerant from the condensor 24 is admitted to a lower portion of the desuperheater 25. Thus, the hot refrigerant gas is admitted into direct and intimate contact with the liquid refrigerant positioned in the lowermost portion of the desuperheater 25. Therefore, the hot refrigerant gas is reduced in temperature so that its normal condensing temperature is obtained. As discussed hereinabove, the outlet line 29 of the desuperheater 25 is connected to the second heat exchanger HX-1. Because the hot refrigerant gas admitted to the lowermost portion of the desuperheater 25 is reduced in temperature to the normal condensing temperature of the refrigerant gas, the heat transfer area of the second heat exchanger HX-1 can be reduced to the minimum amount. This is because the rate of heat transfer per unit of heat exchange area is much higher for a vapor at its saturation temperature than for a superheated vapor. Further it can be seen that the temperature of the $CO_2$, even at static condition, could not exceed the condensing temperature of the refrigerant.

The combined carbonation and refrigeration system of the present invention is a distinct improvement over the conventional, prior art refrigeration system as illustrated in FIG. 1. Since the heat of the refrigerant liquid is utilized to vaporize the cargon dioxide liquid into $CO_2$ gas, this results in a sub-cooled liquid refrigerant. This sub-cooled liquid refrigerant is stored within the receiver $R_1$. Therefore, as the sub-cooled liquid refrigerant is introduced through the expansion valve 22 there is a reduction in the flash gas. This reduction in flash gas increases the net refrigerating effect of the refrigerant. Further, less energy will be required at the compressor for every unit of liquid product which is cooled.

The present invention is also a distinct improvement over the conventional, prior art refrigeration system since the heat required to vaporize the carbon dioxide liquid into $CO_2$ gas can be completely supplied from the high-pressure side of the refrigeration system. By utilizing this heat from the refrigeration system it is not necessary to purchase additional energy for the specific purpose of vaporizing the carbon dioxide liquid.

From the description given hereinabove it will readily be understood that the ratio of required refrigerant flow to $CO_2$ flow will vary depending on seasonal temperature variations. For example, in the summer the refrigerant flow may be high to provide the necessary cooling of the liquid product. However, in the winter the refrigerant flow may be reduced to as little as 10% of the summer demand. On an annual basis the demand for $CO_2$ gas may be almost constant. Therefore, the supply of heat to vaporize the carbon dioxide liquid into $CO_2$ gas must be adequate at any particular point during the seasonal use of the system.

The combined carbonation and refrigeration system of the present invention provides a system whereby the supply of heat to vaporize the carbon dioxide liquid into $CO_2$ gas is adequately supplied regardless of the cooling demand of the system caused by seasonal temperature variations. The combined carbonation and refrigeration system as illustrated in FIG. 2 provides the necessary supply of heat by utilizing two heat exchangers, namely HX-1 and HX-2. During periods of high refrigeration loads the heat exchanger HX-2 can usually supply all of the required heat for vaporizing the carbon dioxide liquid into the required quantity of $CO_2$ gas. This utilization of the heat from the refrigeration system eliminates the need for purchasing a separate form of energy to vaporize the carbon dioxide liquid as is necessary in the conventional, prior art systems. Further the present invention reduces the power requirement for the compressor by sub-cooling the liquid refrigerant which is subsequently delivered to the receiver $R_1$. However, during periods of low refrigeration loads the flow of refrigerant is reduced in proportion to the load reduction. In this situation it may not be possible for all of the required heat to be supplied by the heat exchanger HX-2. In this situation the heat exchanger HX-1 may be utilized to supply an additional source of heat to vaporize the carbon dioxide liquid into $CO_2$ gas. By incorporating two heat exchangers, HX-2, and HX-1, the combined refrigeration and carbonation system of the present invention supplies the necessary heat required to vaporize carbon dioxide liquid into $CO_2$ gas regardless of the cooling demand of the system caused by seasonal temperature variations.

OPERATION OF THE PREFERRED EMBODIMENT

The combination refrigeration and carbonation system of the present invention is preferably operated in two modes. The first mode of operation would correspond to moderate or high refrigeration loads which would seasonally occur throughout any given year. As discussed hereinabove, the required flow of carbon dioxide liquid may be regulated by means of the valve 27. Regulating the flow of carbon dioxide liquid correspondingly regulates the desired pressure of the $CO_2$ gas in the system. The pressure of the gas in the supply line 30 may readily be ascertained by means of the pressure gauge P. As the demand flow of $CO_2$ gas increases the pressure will correspondingly decrease, requiring a greater flow of carbon dioxide liquid through the valve 27. Correspondingly, as the demand flow of $CO_2$ gas decreases a lesser flow of carbon dioxide liquid will be required through the valve 27.

During moderate to high refrigeration loads it is usually only necessary to employ the heat exchanger HX-2. The heat exchanger HX-2 will supply the necessary heat which will be utilized to convert carbon dioxide liquid into $CO_2$ gas. Reviewing FIG. 2, any entrained carbon dioxide liquid which passes through the heat exchanger HX-2 to the vapor-liquid separator 28 will return to the heat exchanger through the conduit 32A and 32B. The conduits 32A and 32B connect the lower portion of the vapor-liquid separator 28 with the heat exchanger HX-2.

In a preferred embodiment of the present invention, the liquid refrigerant passing from the condensor 24 to the heat exchanger HX-2 is at approximately 95° F. The temperature of the liquid refrigerant as it passes through the heat exchanger HX-2 will be reduced from 10°–15° F. up to 50° F. or more, depending upon the relative flow rates of the carbon dioxide liquid and the refrigerant. The net effect of using the liquid refrigerant to vaporize the carbon dioxide liquid into $CO_2$ gas is that the liquid refrigerant supplied to the receiver $R_1$ is at a substantially lower temperature. Therefore, the net useful refrigerating effect of each unit weight of refrigerant will be increased. For a given refrigeration demand, therefore, the number of unit weights which must be compressed is reduced. Subsequently, after the liquid refrigerant has passed through the expansion valve 22 and the evaporator $E_1$, less energy is required at the compressor $C_1$ to increase the pressure of the refrigerant to a value such that the refrigerant may be condensed. Therefore, in a preferred embodiment of the present invention the total heat requirement for vaporizing carbon dioxide liquid into $CO_2$ gas is supplied and the power requirement of the compressor is reduced by approximately 3.5% for the same amount of liquid product refrigerated.

The second mode of operation of the combined refrigerant and carbonation system of the present invention would occur during periods of low refrigeration load caused by seasonal temperature variations. In this mode of operation the heat exchanger HX-2 cannot supply the entire required amount of heat necessary to vaporize the carbon dioxide liquid into $CO_2$ gas. Therefore, a second heat exchanger HX-1 must be utilized to supplement the heat exchanger HX-2. The control of the carbon dioxide liquid during low refrigeration loads is substantially the same as previously discussed. However, the carbon dioxide liquid will flow through the valve 27 and into both the first heat exchanger HX-2 and through the conduit 32B which is connected to the vapor liquid separator 28. However, as the liquid flows upwardly through the conduit 32B it will be directed by means of the conduit 33 to the second heat exchanger HX-1.

In this embodiment of the present invention the valve 26 is regulated to admit hot refrigerant gas from the discharge side of the compressor $C_1$ to the lowermost portion of the desuperheater 25. The hot refrigerant gas entering the desuperheater 25 directly contacts the liquid refrigerant supplied to the lower portion of the desuperheater by means of the conduit 34. The resultant saturated refrigerant gas flows upwardly to the conduit 29 where it is directed to the second heat exchanger HX-1 to supply the necessary heat to vaporize the carbon dioxide liquid into $CO_2$ gas. Similarly as discussed above, any entrained carbon dioxide liquid which passes to the vapor-liquid separator 28 will be returned through the conduit 32A and the conduit 33 back to the second heat exchanger HX-1.

In this embodiment of the present invention assuming that the refrigeration load is only 10% of the normal peak load, the ratio of refrigerant flow to carbon dioxide liquid flow will be approximately 0.7:1. Therefore, the liquid refrigerant flowing through the heat exchanger HX-2 may experience a drop in temperature down to 10°–20° F. In this mode of operation only about 50% of the carbon dioxide liquid vaporizing heat requirement could be supplied. Therefore, the balance of the heat requirement necessary to vaporize the carbon dioxide liquid into $CO_2$ gas must be supplied by the second heat exchanger HX-1.

In this embodiment of the present invention where the combined refrigeration and carbonation system is operating at low refrigeration loads the entire heat requirement for vaporizing carbon dioxide liquid into $CO_2$ gas is supplied. The actual savings in the power requirement of the compressor is approximately half the power requirement which may be saved during peak load operation. Expressed as a percent reduction, against this low laod condition, the actual savings is approximately 17%.

Although throughout the description of the present invention specific reference is made to positioning the various components so as to provide a gravity flow of the liquid refrigerant throughout the system, it will readily be apparent to one with ordinary skill in this art that a pump or a combination of pumps may readily be utilized to supply the necessary refrigerant throughout the system.

It should be understood that the term "compressor" refers to mechanical compressors, an absorber-regenerator combination or any other equivalent device.

Although the above description shows that the heat exchanger which uses the liquid refrigerant as a heat source is placed between the condenser and the receiver, it will be obvious to those skilled in the art that the same result could be obtained if said heat exchanger were placed to receive liquid refrigerant at any point in the system where the refrigerant is in the liquid form.

In the foregoing description, reference is made only to a refrigeration system wherein the refrigerant is compressed in a single stage. As will be obvious to those skilled in the art, the method could be applied to a compound system wherein more than one stage of refrigerant compression exists. Further, the source of heat for vaporizing the carbon dioxide could be obtained from the refrigerant while said refrigerant is at a pressure and temperature intermediate between the stages of compression of said refrigerant.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A carbonation and refrigeration system which utilizes a heat by-product from the refrigeration system to vaporize carbon dioxide liquid into $CO_2$ gas comprising:

refrigeration means for cooling a liquid product including a receiver for supplying a refrigerant to an evaporator means for cooling said liquid product, said refrigernat also being supplied to a compressor means for increasing the pressure of said refrigerant and a condensor means for condensing the refrigerant into a liquid;

carbonation means for introducing $CO_2$ gas into said liquid product, said carbonation means including a supply of liquid carbon dioxide;

first heat exchanger means for transferring a quantity of heat from said condensed liquid refrigerant to said carbon dioxide liquid;

second heat exchanger means for transferring an additional quantity of heat from said refrigerant to said carbon dioxide liquid when refrigeration load conditions of said refrigeration system fall below a predetermined level;

desuperheater means in communication with the refrigerant at the output side of said compressor for lowering the temperature thereof;

conduit means for supplying refrigerant which has passed through said condensor to said first heat exchanger means; and conduit means for supplying refrigerant which has passed through said desuperheater means to said second heat exchanger means.

2. A carbonation and refrigeration system according to claim 1 further comprising:

desuperheater means in communication with the refrigerant at the output side of said compressor for lowering the temperature thereof;

conduit means for supplying refrigerant which has passed through said condensor to first heat exchanger means; and conduit means for supplying refrigerant which has passed through said desuperheater means to said second heat exchanger means.

3. A carbonation and refrigeration system according to claim 1, wherein said $CO_2$ gas and any entrained carbon dioxide liquid are supplied from said first and second heat exchanger means to a vapor-liquid separator wherein the $CO_2$ gas is available to be supplied to said liquid product and said entrained carbon dioxide liquid is recycled through said first and second heat exchanger means.

4. A carbonation and refrigeration system according to claim 1, including a control means for controlling the supply of carbon dioxide liquid into said heat exchanger means.

5. A carbonation and refrigeration system according to claim 4, wherein said control means comprises a valve.

6. A carbonation and refrigerant system according to claim 1, including a regulating means for controlling the supply of refrigerant into said desuperheater means.

7. A carbonation and refrigerant system according to claim 6, wherein said regulating means comprises a valve.

8. A carbonation and refrigeration system which utilizes a heat by-product from the refrigeration system to vaporize carbon dioxide liquid into $CO_2$ gas comprising:

refrigeration means for cooling a liquid product including a receiver for supplying a refrigerant to an evaporator means for cooling said liquid product, said refrigerant also being supplied to a compressor means for increasing the pressure of said refrigerant and a condensor means for condensing the refrigerant into a liquid refrigerant of a given temperature;

carbonation means for introducing $CO_2$ gas into said liquid product, said carbonation means including a supply of liquid carbon dioxide;

first heat exchanger means in communication with said refrigerant after it has been condensed for transferring the heat from the condensed refrigerant to the carbon dioxide of said carbonation means to vaporize said carbon dioxide liquid into $CO_2$ gas and further cool said liquid refrigerant below said given temperature;

means for supplying the further cooled liquid refrigerant to said receiver;

second heat exchanger means for transfering heat from superheated refrigerant gas exiting from said compressor to said carbon dioxide liquid when refrigeration load conditions fall below a predetermined level; and desuperheater means having an input in communication with both superheated refrigerant gas exiting from said compressor and liquid refrigerant exiting from said condensor and having an output in communication with said second heat exchanger means, said liquid refrigerant from said condensor cooling said superheated refrigerant gas to form saturated refrigerant gas, said saturated refrigerant gas being supplied through said output to said second heat exchanger means.

9. A carbonation and refrigeration system according to claim 8, wherein said $CO_2$ gas and any entrained carbon dioxide liquid are supplied from said first heat exchanger means to a vapor-liquid separator wherein the $CO_2$ gas is supplied to said liquid product and said entrained carbon dioxide liquid is recycled through said first heat exchanger means.

10. A carbonation and refrigeration system according to claim 8 wherein said $CO_2$ gas and any entrained carbon dioxide liquid are supplied from said first and second heat exchanger means to a vapor-liquid separator wherein the $CO_2$ gas is supplied to said liquid product and said entrained carbon dioxide liquid is recycled through said first and second heat exchanger means.

11. A carbonation and refrigeration system according to claim 8, including a control means for controlling the supply of carbon dioxide liquid into said heat exchanger means.

12. A carbonation and refrigeration system according to claim 11, wherein said control means comprises a valve.

13. A carbonation and refrigeration system according to claim 8, including a regulating means for controlling the supply of refrigerant into said desuperheater means.

14. A carbonation and refrigeration system according to claim 13, wherein said regulating means comprises a valve.

15. A carbonation and refrigeration system which utilizes a heat by-product from the refrigeration system to vaporize carbon dioxide liquid into $CO_2$ gas comprising:

refrigeration means for cooling a liquid product including a receiver for supplying a refrigerant to an evaporator means for cooling said liquid product, said refrigerant also being supplied to a compressor means for increasing the pressure of said refrigerant and a condensor means for condensing the refrigerant into a liquid refrigerant of a given temperature;

carbonation means for introducing $CO_2$ gas into said liquid product, said carbonation means including a supply of liquid carbon dioxide;

first heat exchanger means in communication with said refrigerant after it has been condensed for transferring the heat from the condensed refrigerant to the carbon dioxide of said carbonation means to vaporize said carbon dioxide liquid into $CO_2$ gas and further cool said liquid refrigerant below said given temperature;

means for supplying the further cooled liquid refrigerant to said receiver;

second heat exchanger means for transferring heat from superheated refrigerant gas exiting from said compressor to said carbon dioxide liquid when refrigeration load conditions fall below a predetermined level;

third heat exchanger means in communication with the refrigerant at the output side of said compressor for lowering the temperature thereof;

conduit means for supplying refrigerant which has passed through said condensor to said first heat exchanger means; and conduit means for supplying refrigerant which has passed through said third heat exchanger means to said second heat exchanger means.

* * * * *